US005943975A

United States Patent [19]

von Burchard

[11] Patent Number: 5,943,975

[45] Date of Patent: Aug. 31, 1999

[54] METHOD OF MAKING THREE-DIMENSIONAL, FLOWER SHAPED PILLOW/CUSHION

[76] Inventor: Angelika von Burchard, 744 Titicus Rd., North Salem, N.Y. 10560

[21] Appl. No.: 08/884,983

[22] Filed: Jun. 30, 1997

[51] Int. Cl.[6] ..... A47G 9/00

[52] U.S. Cl. ..... 112/475.08; 5/636; D6/601

[58] Field of Search ..... 112/475.08, 475.01; 5/636, 640, 641, 645; D6/601

[56] References Cited

U.S. PATENT DOCUMENTS

| | | | |
|---|---|---|---|
| D. 071,533 | 11/1926 | Sevier | D6/601 |
| 247,892 | 10/1881 | Doremus | 5/645 |
| D. 366,176 | 1/1996 | Gish | D6/601 |
| D. 397,575 | 9/1998 | Miller | D6/601 |
| 690,914 | 1/1902 | Bentley | 5/490 |
| 5,437,070 | 8/1995 | Rempp | 5/645 |

*Primary Examiner*—Alexander Grosz
*Attorney, Agent, or Firm*—William H. Dippert

[57] ABSTRACT

A method for the manufacture of a flower-shaped pillow/cushion and the pillow/cushion products formed thereby is disclosed. The flower-shaped pillow/cushion exhibits a soft look and feel while at the same time presenting a three-dimensional configuration which resists flattening and is capable of recovering its three-dimensional appearance even after use.

21 Claims, 14 Drawing Sheets

METHOD OF MAKING THREE-DIMENSIONAL, FLOWER SHAPED PILLOW/CUSHION

FIELD OF THE INVENTION

The present invention relates generally to a method for the manufacture of a flower shaped pillow/cushion and the pillow/cushion products formed thereby. More particularly, the invention relates to a method for the manufacture of an overlapping multi-petal or single petal flower shaped pillow/cushion which exhibits a soft look and feel while at the same time presenting a three-dimensional configuration which resists flattening and is capable of recovering its three-dimensional appearance even after use.

Background of the Invention

While there are techniques for fabricating pillows/cushions, none of these techniques is capable of producing a pillow or cushion which has the particular combination of characteristics which distinguish the products manufactured in accordance with the method of the present invention.

The Applicant is not presently aware of any prior art references which relate to the method of manufacture taught in the present invention or the three-dimensional, multi-petal or single petal flower shaped pillow/cushion products produced thereby.

SUMMARY OF THE INVENTION

The present invention provides for a method for the manufacture of a flower shaped pillow/cushion and the pillow/cushion products formed thereby. More particularly the invention provides for a method for the manufacture of an overlapping multi-petal or single petal flower shaped pillow/cushion which exhibits a soft look and feel while at the same time presenting a three-dimensional configuration which resists flattening and is capable of recovering its three-dimensional appearance even after use.

Objects of the Invention

It is therefore an object of the present invention to provide for a method of fabricating a three-dimensional pillow or cushion.

It is a further object of the present invention to provide for a method of fabricating a three-dimensional pillow/cushion which exhibits a unique combination of characteristics.

It is yet another object of the present invention to provide for a unique three-dimensional pillow/cushion in the configuration of a multi-petal or a single petal flower which is soft, flexible and which retains its three-dimensional shape even after use.

Lastly, it is an object of the present invention to provide for a three-dimensional pillow/cushion in the configuration of a rose.

These and other objects of the invention will become apparent to one skilled in the art from the following more detailed disclosure of the invention.

DETAILED DESCRIPTION OF THE INVENTION

Figure 1C:
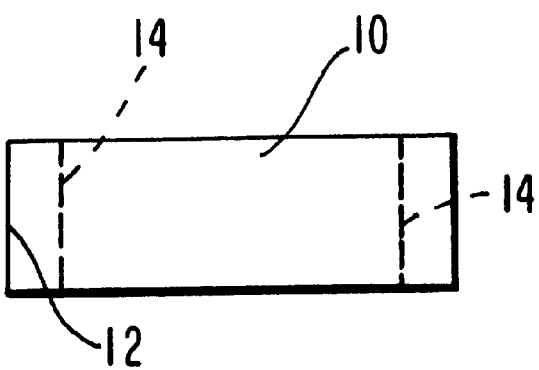
FIGS. 1(*a*) to 1(*c*) are a sequential schematic representation of the initial folding and stitching operation of the flower petal casing material used in the fabrication of the pillow/cushion of the invention.

The basic principles of the method of manufacture of the three-dimensional, multi-petal or single petal flower shaped pillow/cushion in accordance with the present invention are as follows:

Tension is incorporated into each petal by the utilization of a lining material in a particular manner. The method employed requires that both the outer casing (petal pouch) and the inner lining are the same size. However, since the inner lining material has a thickness of approx. 1/16 inch, the inner lining will take up more space or volume within the petal pouch outer casing than the outer casing can provide. As a result, when the inner lining is inserted into the outer casing, it creates tension, and something has to yield. What yields is the inner lining.

The inner lining material tends to yield on the side that presents the least resistance, which is the folded over side. Since the casing's and the lining's folded-over sides nestle into each other, what yields on the inside is reflected on the outside casing as a widening of its folded-over side. This effect is what imparts the flower pillow/cushion of the present invention with its "soft" look and feel. The tension which is incorporated into each flower petal by the method of the present invention is also sufficient to give the petals their standup capability. Without this standup capability, it would not be possible to configure the petal pouches with their lining into the form of a three-dimensional flower. Each petal pouch and its inner lining has a geometric shape, which starts out looking quite differently from the appearance of a natural flower petal. Because of the intrinsic flexibility of both of the materials used in the construction of each petal, it is possible, even when the lining material has been inserted into the casing and there is tension present, to bend the edges in such a manner/pattern, so as to create the look and feel of an unfurling flower petal effect. This manner/pattern also incorporates in its execution a crucial step to maintaining the lining within the parameters of the pouch, and contributes to the three-dimensional look, since it creates space between the rows of flower petals in the final construction of a multi-petal flower. The act of folding, rather than using a sewn seam to shape the edge of the flower petal, also contributes to the "soft and flowing" look of the flower pillow/cushion of the present invention. The thickness of the lining material used in the flower petal must be in proportion to the weight of the material used for the casing of the petal. A very heavy material would require a proportionally heavier gauge of lining material, as might a very large flower petal, as might be used, for example, in fabricating a large flower shaped floor cushion.

The petal depth is constant in this design execution, although, the lengths of the petals vary, as detailed hereinbelow. In other variations the petal depth may also be varied to impart a different floral effect. The breadth, which refers to the folded-over edge of each flower petal, cannot be stated with exactitude, as it varies and depends on the length of the petal. The longer the petal, the greater its breadth, due to the fact that the area of unrestricted movement that the lining material has within a longer petal casing construction is itself longer. The actual size of the flower petals, which is dependent upon the size of the pillow/cushion which is being constructed, must be in proportion to the overall size of the pillow/cushion, The actual size of the flower-shaped pillow/cushion will depend on what the marketplace determines is the most appealing to the purchaser. The flower-shaped pillow/cushion according to the present invention need not necessarily consist of a single flower. It can also be constituted as a bouquet of flowers, i.e., with several smaller flowers sewn together. In this case the petal size of each flower would be proportionally reduced in depth and length. If, however, the pillow/cushion to be constructed were to be a large floor cushion, the petals would have to be proportionally larger.

The color of the flower-shaped pillow/cushion according to the present invention need not necessarily be a uniform red, yellow or white, etc., but may vary throughout the flower itself. Indeed, by creating a color design specifically for each petal, it is possible to make a flower pillow/cushion having the most intricate and sophisticated shadings of color.

The flower-shaped pillow/cushion according to the invention need not necessarily consist of a multi-petal flower. It can also be constituted as a single petal, such as a lily.

The flower-shaped pillow/cushion of the present invention can be designed in such a manner that it is mass-producable with a minimum of individual variation. All sewing lines and attachment point indicators can be pre-printed on the casing fabric for each petal, and every petal can be given a numerical number to insure the correct sequence of attachment from petal to petal. A two inch border is provided around the petal which, upon completion of the construction of the flower-shaped pillow/cushion, disappears from view, and upon which all the necessary guide lines and instructions can be pre-printed. Nonetheless, it is anticipated that each flower-shaped pillow/cushion will have its own slight variations, as no two workers will construct precisely the same item every time.

The following represents a preferred embodiment of the method of the invention and is a step by step description of the fabrication of a typical rose flower shaped pillow/cushion according to the present invention.

In the following design the rose flower consists of fifteen individual lined petals, a back panel, back panel lining, and eight pieces of ribbon or material.

Step 1—Cut casing material for each of the flower petals to the following sizes:

| | | | |
|---|---|---|---|
| Petal #1 | = | 12 × 12 | inches (length × depth) |
| 2 | = | 17 × 12 | " |
| 3 | = | 19 × 12 | " |
| 4 | = | 16 × 12 | " |
| 5 | = | 16 × 12 | " |
| 6 | = | 16 × 12 | " |
| 7 | = | 16 × 12 | " |
| 8 | = | 16 × 12 | " |
| 9 | = | 16 × 12 | " |
| 10 | = | 19 × 12 | " |
| 11 | = | 19 × 12 | " |
| 12 | = | 19 × 12 | " |
| 13 | = | 20 × 12 | " |
| 14 | = | 20 × 12 | " |
| 15 | = | 20 × 12 | " |

Step 2—Cut casing material for back panel to a size of 16×16 inches.

Step 3—Using either commercially available ribbon, or cut strips of casing material, create a total of 8 pieces that are 1 inch wide by 16 inches long.

Step 4—Cut lining material for each of the petals to the following sizes:

| | | | |
|---|---|---|---|
| Petal #1 | = | 8 × 8 | inches (length × depth) |
| 2 | = | 13 × 8 | " |
| 3 | = | 15 × 8 | " |
| 4 | = | 12 × 8 | " |
| 5 | = | 12 × 8 | " |
| 6 | = | 12 × 8 | " |
| 7 | = | 12 × 8 | " |

-continued

| | | |
|---|---|---|
| 8 = | 12 × 8 | " |
| 9 = | 12 × 8 | " |
| 10 = | 15 × 8 | " |
| 11 = | 15 × 8 | " |
| 12 = | 15 × 8 | " |
| 13 = | 16 × 8 | " |
| 14 = | 16 × 8 | " |
| 15 = | 16 × 8 | " |

Step 5—Cut back panel lining material to form two rounds of 8 inch in diameter each.

The cut edges of all materials in Steps 1–5, are left as is, that is to say they are not hemmed or finished off in any manner.

Step 6—Forming the individual petals:

Sew all Petals #1 to #15 together according to the following procedure. In essence sewing fifteen individual pouches to receive the fifteen corresponding individual linings.

Figure 1B:
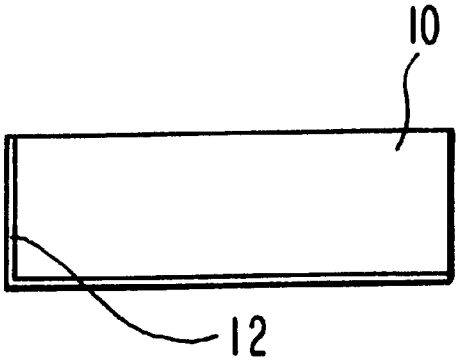
Figure 1A:
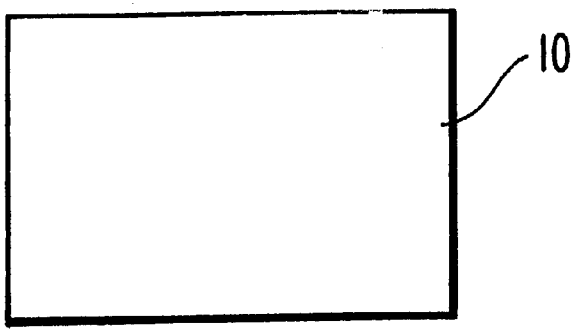

Start with Petals #2 through 10, and 14 & 15 and proceed as depicted in FIGS. 1*a*–1*c:* The side being folded over is referred to as the depth.

Place the petal casing 10 material down flat with the wrong side facing up.

Fold the casing material over, so that the edges 12 are aligned. The material facing up is now is the right side.

Sew both ends together. The seam 14 must be located 2 inches in from the edge, on each side.

Figure 2B:
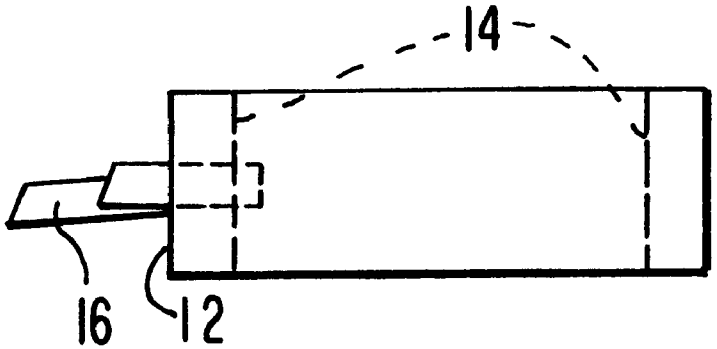
FIGS. 2(*a*) to 2(*b*) are a sequential schematic representation of the insertion and stitching in of the ribbons into the Petal #1 casing for use in the fabrication of the pillow/cushion of the invention.
Figure 2A:
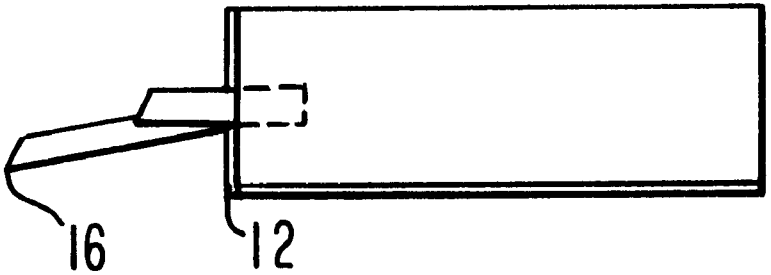

For Petal #1, incorporate two ribbons 16 into the petal construction as depicted in FIGS. 2(*a*) and 2(*c*). It is immaterial on which end this is done.

Sandwich both ribbons 16 between the two pieces of cloth, making sure it is in about 3" from the edge 12.

Proceed as noted above, making sure the ribbons 16 are anchored in seam 14.

Figure 3B:
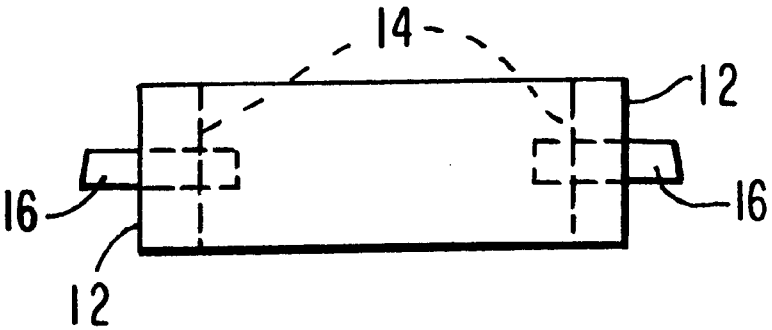
FIGS. 3(*c*) to 3(*b*) are a sequential schematic representation of the insertion and stitching in of the ribbons into Petals #11, 12 and 13 casing for the fabrication of the pillow/cushion of the invention.
Figure 3A:
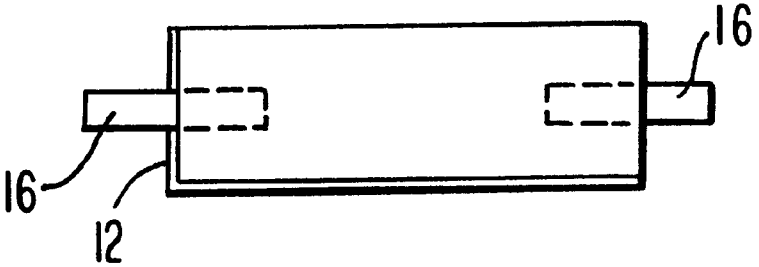

For Petals #11, 12, and 13, incorporate two ribbons in each petal as depicted in FIGS. 3(*a*) and 3(*b*). One ribbon per side only.

Proceed as indicated above, but insert ribbons 16 on both edges 12, one ribbon per side.

Figure 4:
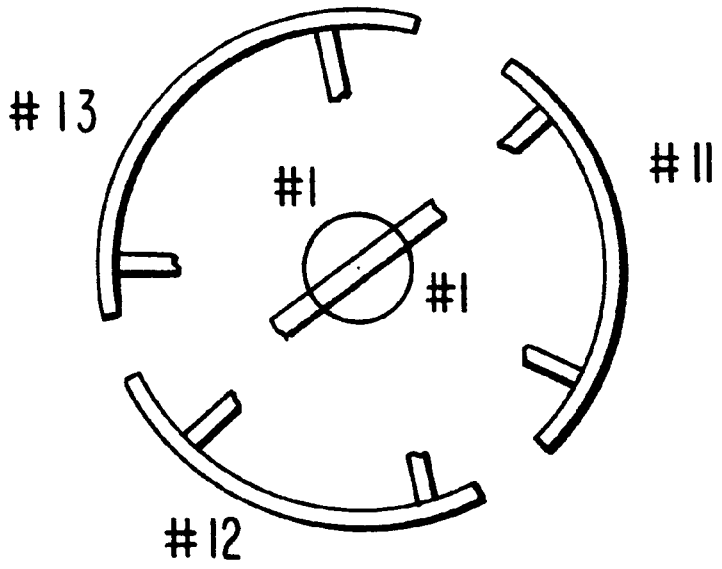
FIG. 4 is a schematic representation of the relationship of Petals #1, 11, 12, and 13 in the pillow/cushion of the invention.

These ribbons are a very important element of the rose pillow/cushion, and must to be incorporated into these specific petals as depicted, because when all the petals have been sewn together, the center of the flower (Petal #1) has a tendency to pop up unless restrained. To prevent this from happening the center has to be anchored as depicted in FIG. 4, which is a schematic representation only. If the center ribbons are only attached to one outer petal, the flower's structure will not be equal on all sides. Attaching all the various ribbon ends together and to the central petal, tends to open up the outer ring of petals.

Providing a ribbon 16 at each end of Petals #11, 12, 13 is somewhat redundant, however, since the rose pillow/cushion construction will no doubt be sewn together in a commercial sewing factory environment, providing redundant attachment points insures that there will be a ribbon available to tie to the center petal at 90 degrees intervals.

The fastening of these ribbons is accomplished after the rose petals have been sewn together by knotting the ends of the ribbons together or by other suitably means.

At this point in the fabrication each petal-pouch encloses the lining on three sides only, as the bottom of each pouch remains open.

This arrangement is not sufficient to maintain tension, as the pouch has to be the exact size of the lining and substantially enclose it on all sides.

Figure 5:
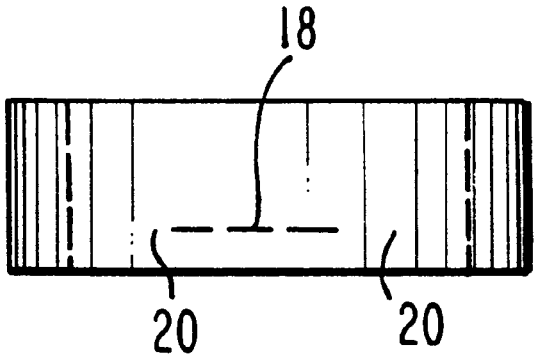
FIG. 5 is a schematic representation of the stitching for a typical petal casing showing the end stitching and partial bottom stitching for use in the fabrication of the pillow/cushion of the invention.

As it is next to impossible to seam with the necessary precision of exactly two inches up from the bottom once the lining is in place, it is therefore necessary to close the bottom of each petal casing material without the lining in place, in such manner that still allows for the insertion of the lining material. This step is accomplished by sewing a partial seam 18 in the center of the bottom edge of the petal pouch, as depicted in FIG. 5, the length of which seam is proportional to the length of the individual petal-pouch.

Such a partial seam 18 is sufficient to hold the lining in position temporarily, however, the lining will still be able to dissipate its tension downwards, through the open sides 20 next to partial seam 18. As will be seen hereinafter, this problem is resolved by making the sewn point of attachment of the folded down corners of each individual petal approximately ½ inch up from the sewing line, thereby incorporating the lining into the attachment point.

The following is a tabulation of the approximate length of the center-seam for each of the Petal-pouches #1–15.

| Petal-pouch | length of center-seam |
|---|---|
| #1 | 1 inch |
| 2 | 3 |
| 3 | 5 |
| 4 | 2 |
| 5 | 2 |
| 6 | 2 |
| 7 | 2 |
| 8 | 2 |
| 9 | 2 |
| 10 | 5 |
| 11 | 5 |
| 12 | 5 |
| 13 | 6 |
| 14 | 6 |
| 15 | 6 |

The Petal-pouch is now ready for the insertion of the lining.

Figure 6C:
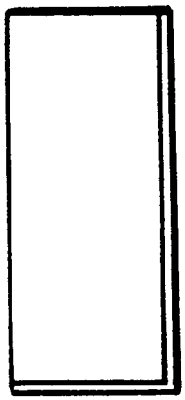
FIGS. 6(*a*) to 6(*c*) are a sequential schematic representation of the folding of the lining material for use in forming the rose petals used in the fabrication of the pillow/cushion of the invention.
Figure 6B:
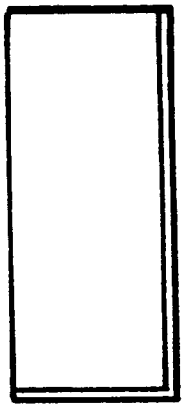
Figure 6A:
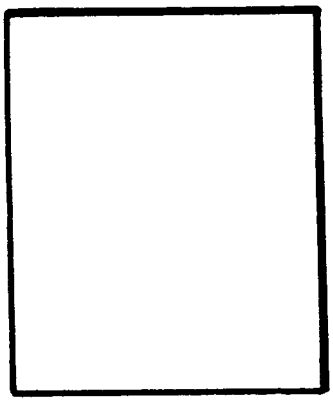

Step 7—Inserting the Lining Material:

The lining material is folded over in the manner depicted in FIGS. 6(*a*)–6(*c*), and then inserted into the appropriate petal-pouch. As there is no right or wrong side to the lining material, therefore it is immaterial which side is folded over.

Proceed to fabricate each lining piece as follows: The side being folded over is the depth.

Place the lining material down as shown in FIG. 6(*a*). There is no right or wrong side.

Fold the lining material as shown in FIG. 6(*b*), so that the ends are together.

Stroke the lining material lightly across the fold so that it flattens out across the fold as shown in FIG. 6(*c*). It is critical not to iron or put a permanent crease into the folded edge.

Figure 7:
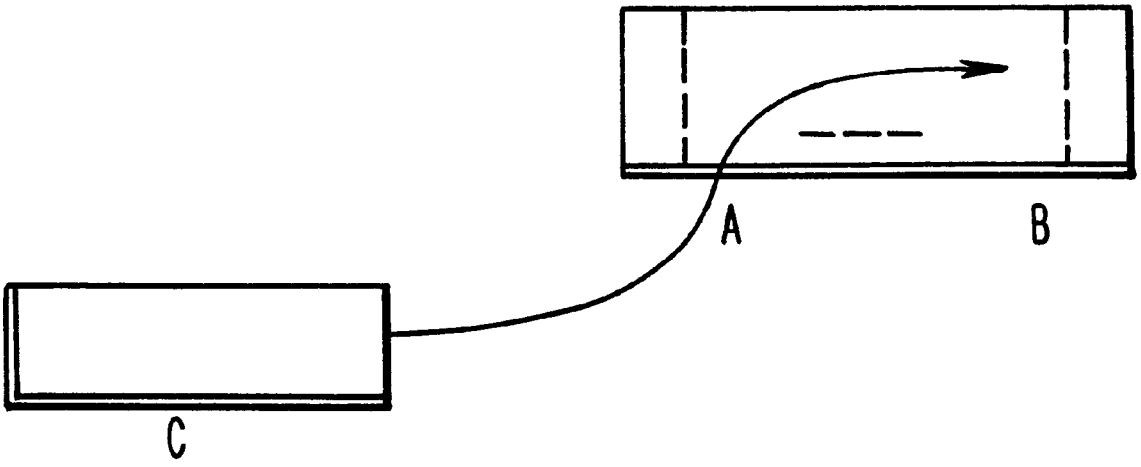
FIG. 7 is a schematic representation of the insertion of the folded lining material into a typical petal casing for use in the fabrication of the pillow/cushion of the invention.

Insert the folded over lining into the appropriate pouch, as depicted in FIG. 7. Since both the lining and the interior of the pouch have the same measurements at this point in the fabrication, the insertion has to be done meticulously. The end product is a smooth looking and bouncy flower petal.

The following is the preferred procedure for insertion of the petal lining material into the casing.

Place right hand into pouch opening B. (See FIG. 7).

With other hand push lining through opening A. (See FIG. 7).

Grasp the lining material with the right hand and push/pull it through until it fits snugly within the casing pouch.

Figure 8:
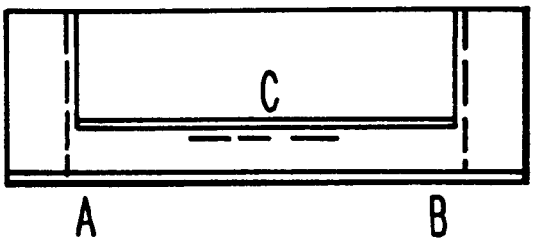
FIG. 8 is a schematic representation of the lining material after insertion into a typical petal casing used in the fabrication of the pillow/cushion of the invention.

Smooth out the lining material within the petal casing, so that it is appears smooth and bouncy, to form the completed petal shown in FIG. 8.

Step 8—Shaping the petals:

The next step, prior to sewing the petals together to form the rose, is to give them the soft upper edge and unfurling sides.

This step also incorporates the anchoring or attachment of the lining into its correct position to maintain tension.

Figure 9A:
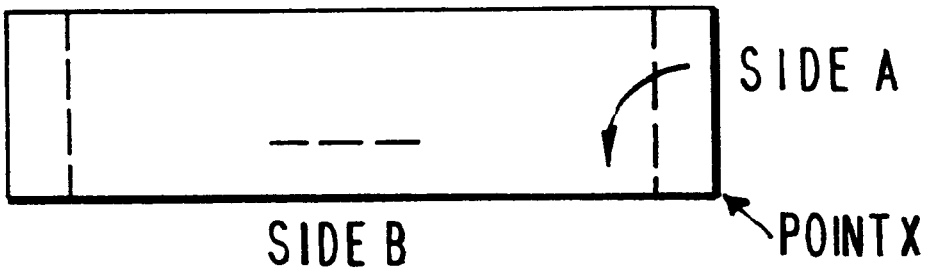
FIGS. 9(*a*) to 9(*c*) are a sequential schematic representation of the fold over and attachment of a typical petal end.
Figure 9B:
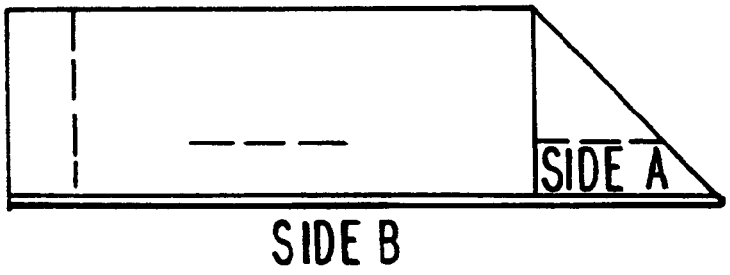
Figure 9C:
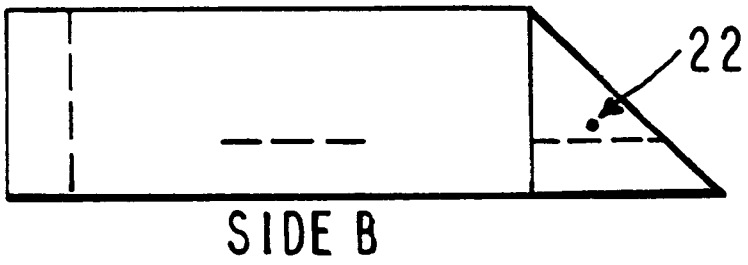

The attachment point functions as a substitute for closure of the two open areas of the pouch, and prevents the displacement of tension downwards rather than upwards against the folded over side. That this has not already occurred must be checked prior to preceding, and if so, the lining material must be pushed back up into its correct position prior to sewing, according to the following procedure:

With reference to FIGS. 9(*a*)–9(*c*),

Using point X as the pivot, fold over side A onto side B. Check that the lining material is in the correct position.

Make sure that the outer edge of side A is flush with the outer edge of side B.

Sew both sides together with "in situ" stitches. Attachment point 22 should be two inches in on the sewing line and ½ inch above sewing line. This stitch also serves to anchor the lining material in a fixed position.

Figure 10A:
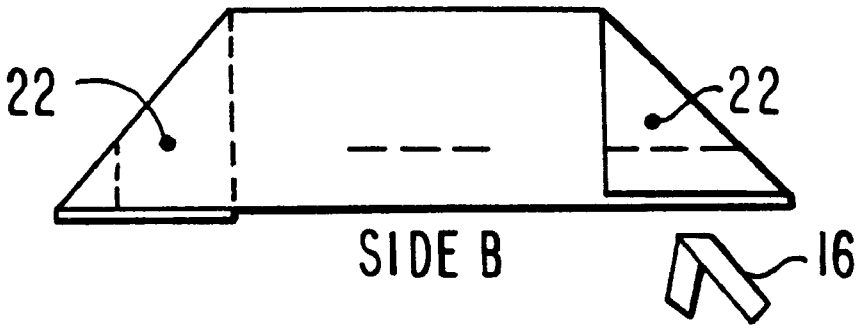
FIGS. 10(*a*) and 10(*b*) are schematic representations of fold over patterns for Petals #1 and Petals #2–15 respectively.
Figure 10B:
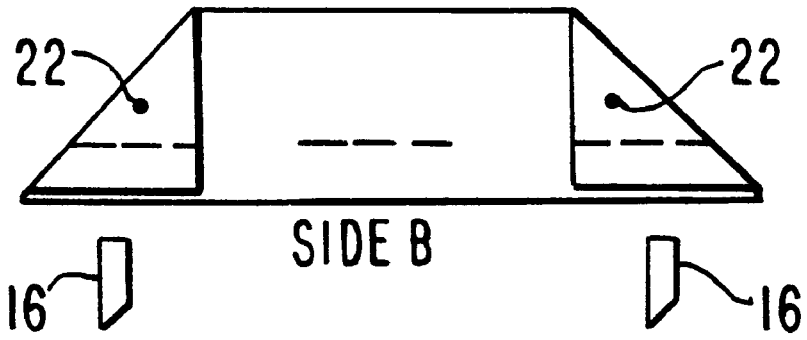

The fold-over pattern for the various petals is as depicted in FIGS. 10 (*a*) and 10(*b*):

Petal #1 is folded over on opposite sides. One side will now have two ribbons 16 coming out of side B. (See FIG. 10(*a*)).

Petals #2 through #15 are folded over on same side. For Petals #11, #12, #13, each of these petals will now have a ribbon 16 on each end of side B. (See FIG. 10(*b*)).

Step 9—Assembling the petals into a rose:

The method used is to form an ever-widening coil around Petal #1, which forms the center of the rose construction, as follows:

Petal #1 is first folded into a circle.

Petal #2 is then wrapped around Petal #1 and attached to it.

Petals #3 through #15, are then added, each in turn being attached to the end of the preceding petal by an overlap, and thereupon also to the petal that is situated thereunder. The attach-point is always ½" above the sewing line.

The folded-over corners of the petals must always face outwards as these petals are being attached to each other. What this accomplishes is to create a space between the rows of petals and, at the same time, gives each petal the necessary individual prominence.

The exception is the above Petal #1 where the fold-over is on opposing sides, and only one side faces outward once the petal has been turned into a circle. The other fold-over then faces inward into the circle/center of the rose, and fills that otherwise open space.

To maintain a look of fluidity or looseness, it is essential, that the attachment of one petal to the other be only with the preceding petal, and following that, with the next underlaying petal.

Furthermore, it is also of importance that the point of attachment be kept to a small area, namely, a single in situ multi-stitch; and also that these points of attachment be kept to a bare minimum.

Optimally there should be only three attachment points per petal at the beginning of the coil, i.e, one at each end and one in the middle. For the outer petals there should only be a maximum of five attachment points.

Step 10—Attaching the ends of the ribbons together:

Upon completion of Step 9, the rose is turned over, and the ribbons which emanate from Petals #11, #12, #13 are knotted to the two ribbons 16 from Petal #1. If there is an excess in the length of the ribbons, the ends are cut off. As previously noted the function of attaching the ribbons to each other by knotting, is to keep the center of the rose from popping up and to give the rose stability.

Step 11—Closing up of the rear of the rose pillow/cushion:

First position the two 8" diameter rounds of lining material over the back of the knotted construction of rose petals, and lightly tack at intervals in order to hold it in place.

Next take the previously cut 16"×16" piece of backing material and center it over the back of the constructed pillow/cushion. The right side of the material must face outwards.

Then fold the backing material over at the base of the petals, and with an invisible stitch, anchor it all along the base of the outermost petals to cover all prior stitching/sewing.

The following is a detailed step by step procedure for assembling the petals into a rose pillow/cushion according to the preferred embodiment of the present invention.

Petal #1

Figure 11A:
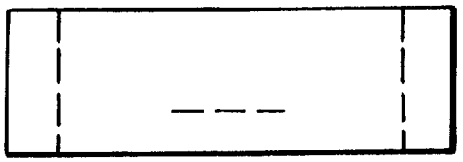
FIGS. 11(*a*) to 11(*c*) are schematic representations of the stitching, fold over and geometry for Petal #1.
Figure 11B:
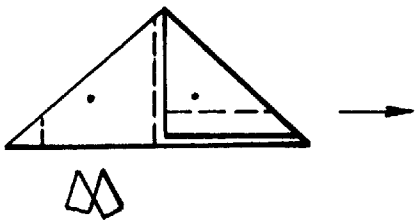
Figure 11C:
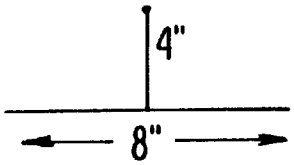

The size of this petal is 8" long, with a depth of 4". Once the fold-over has been completed, this petal in essence has been folded into a triangle with an eight inch base as depicted in FIG. 11(*a*)–11(*c*).

Figure 12:
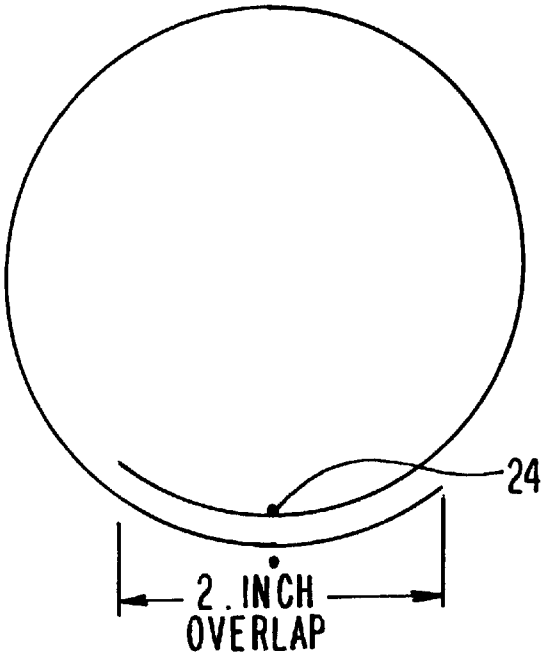
FIG. 12 is a schematic representation of the overlapping and stitching of Petal #1 into a circle.

The ends of the base of the triangle are next folded over each other with an overlap of two inches as depicted in FIG. 12.

The overlapping pieces are attached to each other by an in situ multi-stitch 24.

Figure 13:
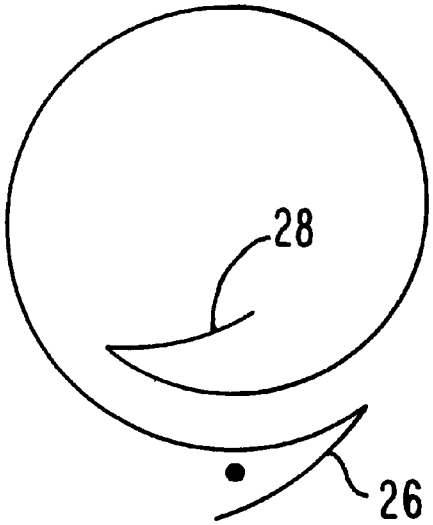
FIG. 13 is a schematic representation of the orientation of the fold overs for Petal #1 after forming it into a circle.

When these ends are overlapped, the outermost's fold-over 26 must face outwards as shown in FIG. 13.

It then follows automatically that the innermost's fold-over 28 will face into the circle that has been created.

Figure 14A:
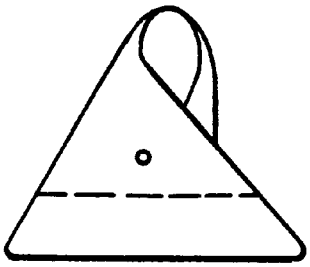
FIGS. 14(*a*) and 14(*b*) are schematic representations of the configuration of Petal #1 after being formed into a circle.
Figure 14:
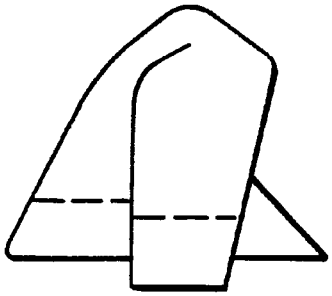

The individual finished petals look approximately as illustrated in FIGS. 14(*a*) and 14(*b*).

Petal #2

Figure 15A:
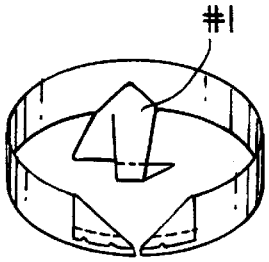
FIGS. 15(*a*) and 15(*b*) are schematic representations of Petal #2 wrapped around Petal #1.
Figure 15B:
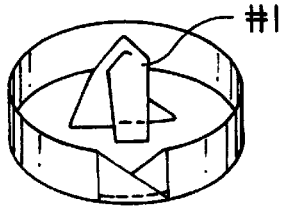

Petal #2 is wrapped around Petal #1, as shown in FIGS. 15(*a*) and 15(*b*). Depending on how the center was made, the ends of Petal #2 will either meet point to point (FIG. 15(*a*)), or overlap slightly (FIG. 15(*b*)). The petal end to the left is always the attachment point for Petal #3, and so on.

Petal #3 through #15

Figure 16:
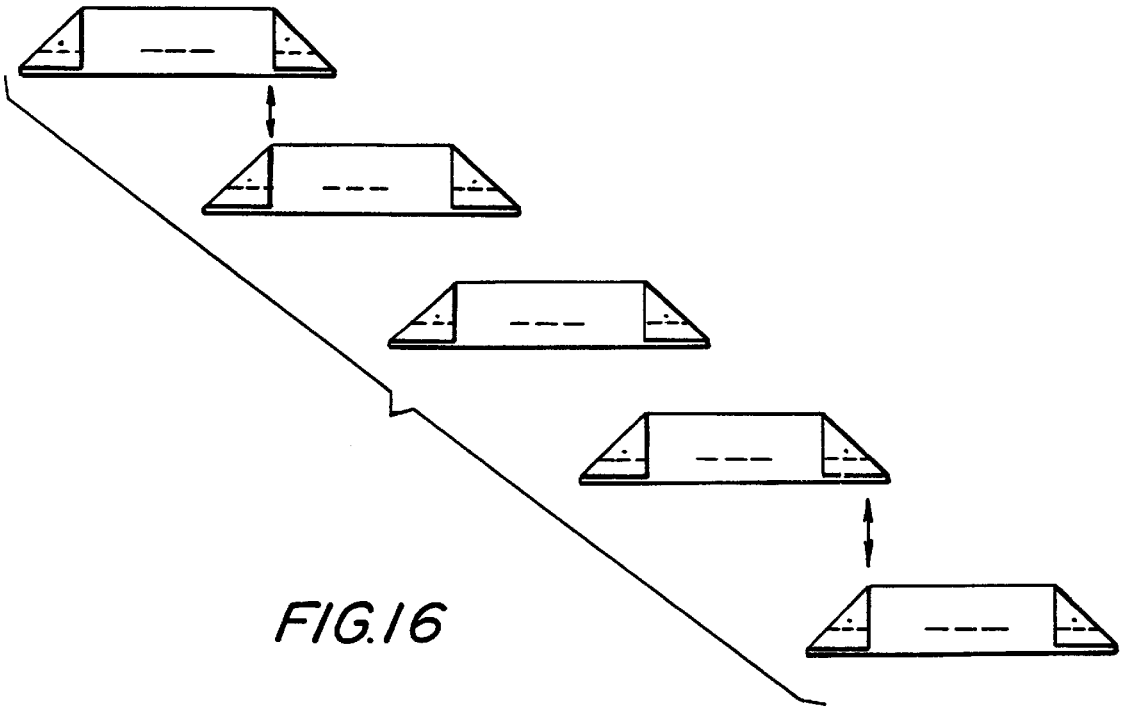
FIG. 16 is a schematic representation of the overlapping of sequential petals in forming the pillow/cushion of the invention.

The petals are positioned relative to each other by aligning the fold-over areas as depicted in FIG. 16, that is to say, each petal is attached to the preceding petal by an eight inch set back.

If more variation is desired in the look of the rose, this set back pattern can be interrupted by reducing the set back to six inches, every once in a while.

The attachment method is as follows:

The stitching line is 2½" up from bottom of petal. Stitch is in situ multi-stitch.

Figure 17:
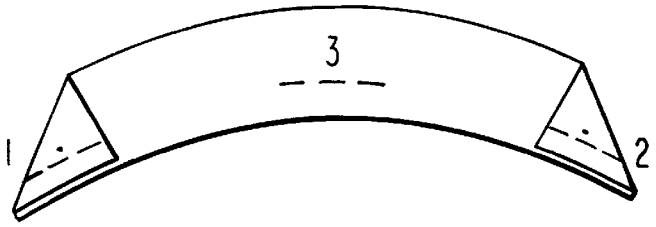
FIG. 17 is a schematic representation of a typical petal showing its two end attachment points.

Position the petal with relation to preceding petal as shown in FIG. 16 and 17, and attach point to preceding petal.

Drape the petal forward, making sure it is loose enough to give movement, then attach forward point to the underlaying petal.

Attach the petal in the middle.

Figure 18:
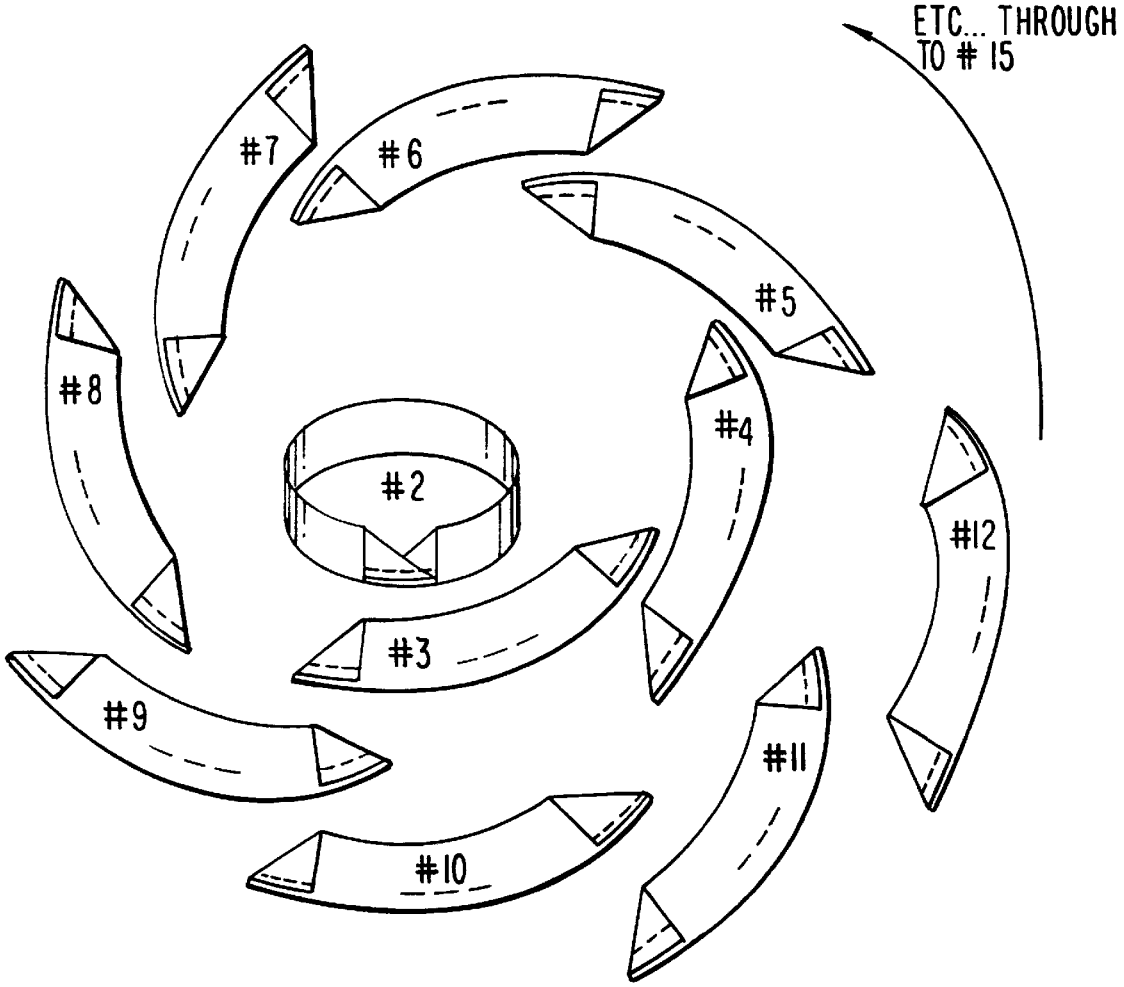
FIG. 18 is a schematic representation of a typical coil arrangement of the petals in a typical pillow/cushion of the invention.

The coil pattern which is formed by the attached petals looks approximately as shown in FIG. 18.

Step 12—Finishing off the rose, and closing up the back: The procedure to be followed is:

Turn pillow over.

Figure 19:
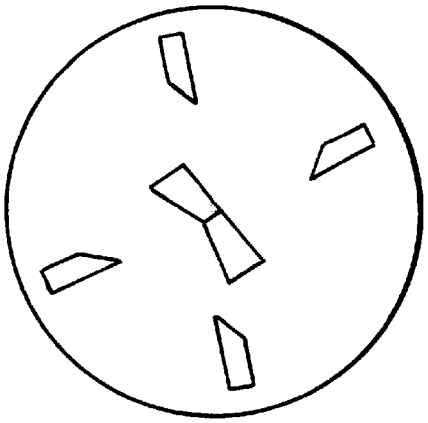
FIG. 19 is a schematic representation of the arrangement of the attachment ribbons to be knotted after the petals have been attached one to the other.

Knot outer ring ribbons to the center ribbons. Use the available outer ring ribbons that insure an approximate tie at every 90° around the circle, as shown in FIG. 19. Excess or unused ribbon can be cut off.

Center the 8" diameter lining material rounds one on top of the other.

Figure 20:
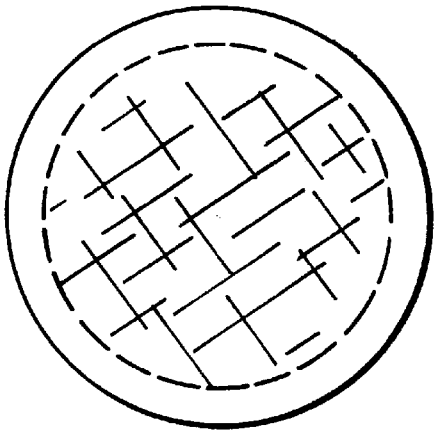
FIG. 20 is a schematic representation of the bottom of a typical pillow/cushion according to the invention showing the backing liner tacked into place.

Tack the lining material with a few stitches to back of the rose pillow/cushion, as shown in FIG. 20, to insure they stay in place.

Figure 21:
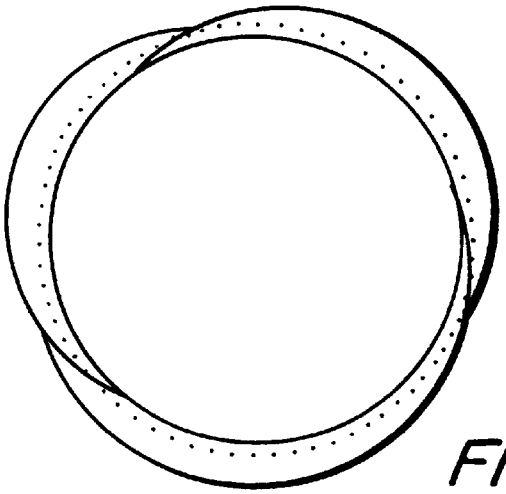
FIG. 21 is a schematic representation of the bottom of a typical pillow/cushion according to the invention showing the backing material stitched into place.

Center the 16"×16" back panel over the back, right side facing outwards, as shown in FIG. 21.

Fold over the edge so that it covers any visible petal stitches. These stitches will be about ½" inch up from the edge of the petals.

Stitch back panel to the petals, using an invisible stitch, such as a slip-stitch.

Figure 22:
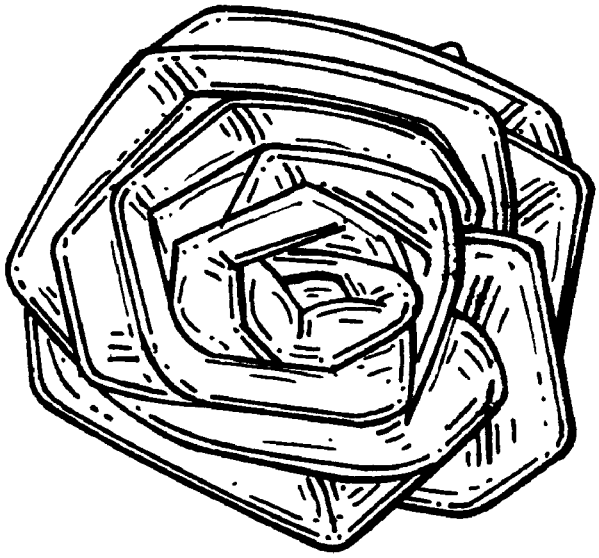
FIG. 22 is an oblique view of a multi-petal flower-shaped pillow/cushion prepared according to the invention.

An example of such a finished product can be seen in FIG. 22.

It is contemplated that the techniques and method of fabrication which are disclosed and claimed in the present invention will also be equally effective in the fabrication of pillows/cushions of other flowers and layered items which are similar in shape to the petals of a rose, and to the fabrication of other non-flower constructions which resemble these shapes in their appearance.

Figure 23:
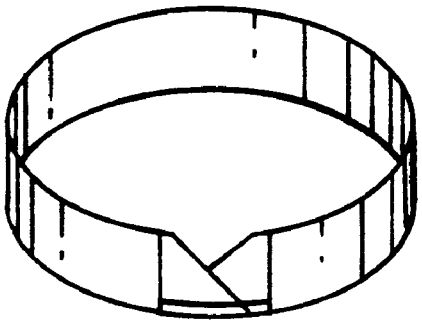
FIG. 23 is an oblique view of a single petal flower-shaped pillow/cushion prepared according to the invention.

It is also contemplated that the techniques and method of fabrication which are disclosed and claimed in the present invention will be equally effective to in the fabrication of pillows/cushion which will consist of single petal flowers such as lilies. A representative single petal shaped-flower pillow-cushion is shown in FIG. 23.

It will thus be seen that the objects set forth above, among those made apparent from the preceding description, are efficiently attained. Since certain changes may be made in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A method of fabricating a three-dimensional, multi-petal flower-shaped pillow/cushion comprising the steps of:

fabricating a multiplicity of individual petals;

attaching to a selected number of said individual petals at least two knotting ribbons;

fabricating said multiplicity of individual petals into a coiled pattern to simulate the pattern of naturally occurring flower petals;

attaching said multiplicity of individual petals, one to the other;

knotting said ribbons together to restrain the petals; and finishing the back of said multiplicity of attached petals to create a smooth neat appearance.

2. The method of fabricating a three-dimensional, multi-petal flower-shaped pillow/cushion according to claim 1, wherein the step of fabricating the multiplicity of individual petals comprises incorporating tension into each of said petals by incorporating an inner lining material into a prefabricated outer casing, such that said outer casing and said lining material are initially made to the same size and said lining material has a thickness that causes the volume of the inner lining material to exceed the available volume within said outer casing.

3. The method of fabricating a three-dimensional, multi-petal flower-shaped pillow/cushion according to claim 1, wherein the step of fabricating the multiplicity of individual petals comprises:

cutting casing material to a predetermined size for each of said petals;

cutting strips of casing material or cutting lengths of preformed ribbon to form attachment ribbons of a predetermined size;

cutting inner lining material to a predetermined size for each petal; and forming each of the individual petals by sewing the precut casing material, incorporating the precut ribbons into the ends of selected petals and inserting the precut inner lining material into the casing material.

4. The method of fabricating a three-dimensional, multi-petal flower-shaped pillow/cushion according to claim 1 wherein the shaped pillow/cushion is a rose-shaped flower which consists of fifteen individual lined petals, a back panel, back panel lining and eight pieces of knotting ribbon.

5. The method of fabricating a rose-shaped pillow/cushion according to claim 4 comprising the following steps:

cutting casing material for petals to the following sizes:

| | | | |
|---|---|---|---|
| Petal #1 | = | 12 × 12 | inches (length × depth) |
| 2 | = | 17 × 12 | " |
| 3 | = | 19 × 12 | " |
| 4 | = | 16 × 12 | " |
| 5 | = | 16 × 12 | " |
| 6 | = | 16 × 12 | " |
| 7 | = | 16 × 12 | " |
| 8 | = | 16 × 12 | " |
| 9 | = | 16 × 12 | " |
| 10 | = | 19 × 12 | " |
| 11 | = | 19 × 12 | " |
| 12 | = | 19 × 12 | " |
| 13 | = | 20 × 12 | " |
| 14 | = | 20 × 12 | " |
| 15 | = | 20 × 12 | " |

cutting casing material for the back panel into a 16×16 inch square;

cutting strips of casing material or cutting lengths of preformed ribbon into a total of eight pieces each of which are 1 inch wide by 16 inches long;

cutting lining material for petals to the following sizes:

| | | | |
|---|---|---|---|
| Petal #1 | = | 8 × 8 | inches (length × depth) |
| 2 | = | 13 × 8 | " |
| 3 | = | 15 × 8 | " |
| 4 | = | 12 × 8 | " |
| 5 | = | 12 × 8 | " |
| 6 | = | 12 × 8 | " |

-continued

| | | |
|---|---|---|
| 7 = | 12 × 8 | " |
| 8 = | 12 × 8 | " |
| 9 = | 12 × 8 | " |
| 10 = | 15 × 8 | " |
| 11 = | 15 × 8 | " |
| 12 = | 15 × 8 | " |
| 13 = | 16 × 8 | " |
| 14 = | 16 × 8 | " |
| 15 = | 16 × 8 | " |

cutting back panel lining material to form two rounds each of which is 8 inches in diameter;

forming the individual petals;

inserting the lining material;

shaping the petals;

assembling the petals into a rose;

attaching the ends of the ribbons together: and closing up of the rear of the rose-shaped pillow/cushion.

6. The method of fabricating a multi-petal flower-shaped pillow/cushion according to claim 1, wherein the individual petals are formed in the shape of rose petals.

7. The method of fabricating a flower-shaped pillow/cushion according to claim 1, wherein the pillow/cushion has the three-dimensional appearance of a bouquet of flowers, which comprises a multiplicity of different individual multi-petal flowers.

8. The method of fabricating a flower-shaped pillow/cushion according to claim 1, wherein the pillow/cushion has three-dimensional appearance of a bouquet of flowers, which comprises a multiplicity of individual rose-shaped flowers.

9. The method of fabricating a flower-shaped pillow/cushion according to claim 1, wherein the pillow/cushion has the three-dimensional appearance of a bouquet of flowers, which comprises a multiplicity of individual flowers of different varieties.

10. The method of fabricating a flower-shaped pillow/cushion according to claim 1, wherein the pillow/cushion has the three-dimensional appearance of a flower of one color.

11. The method of fabricating a flower-shaped pillow/cushion according to claim 1, wherein the pillow/cushion has the three-dimensional appearance of a flower of more than one color.

12. The method of fabricating a flower-shaped pillow/cushion according to claim 1 wherein the pillow/cushion has the three-dimensional appearance of a bouquet of flowers of one color.

13. The method of fabricating a flower-shaped pillow/cushion according to claim 1 wherein the pillow/cushion has the three-dimensional appearance of a bouquet of flowers of more than one color.

14. The method of fabricating a three-dimensional, single petal flower-shaped pillow/cushion comprising the step of incorporating an inner lining material into an outer casing, wherein said outer casing and said lining material are substantially of the same size and wherein said lining material has a thickness that causes the volume of the inner lining material to exceed the available volume within said outer casing, to cause tension within the petal flower-shaped pillow/cushion.

15. The method of fabricating a three-dimensional, single petal flower-shaped pillow/cushion according to claim 14, wherein the step of fabricating the individual petal comprises:

cutting casing material to a predetermined size for said petal;

cutting inner lining material to a predetermined size for the petal; and forming the individual petal by sewing the precut casing material and inserting the precut inner lining material into the casing material.

16. The method of fabricating a three-dimensional, single petal flower-shaped pillow/cushion according to claim 14 wherein the shaped pillow/cushion is a lily shaped flower.

17. The method of fabricating a flower-shaped pillow/cushion according to claim 14, wherein the pillow/cushion has the three-dimensional appearance of a bouquet of flowers, which comprises a multiplicity of different individual single-petal flowers.

18. The method of fabricating a flower-shaped pillow/cushion according to claim 14, wherein the pillow/cushion has the three-dimensional appearance of a bouquet of flowers, which comprises a multiplicity of individual lily shaped flowers.

19. The method of fabricating a flower-shaped pillow/cushion according to claim 14, wherein the pillow/cushion has the three-dimensional appearance of a flower of one color.

20. The method of fabricating a flower-shaped pillow/cushion according to claim 14, wherein the pillow/cushion has the three-dimensional appearance of a flower of more than one color.

21. A method of fabricating a three-dimensional, flower-shaped pillow/cushion comprising the steps of:

fabricating a multiplicity of individual petals according to the method of claim 14;

fabricating said multiplicity of individual petals into a coiled pattern to simulate the pattern of naturally occurring flower petals;

attaching said multiplicity of individual petals, one to the other to restrain them; and finishing the back of said multiplicity of attached petals to create a smooth neat appearance.

* * * * *